US007819782B2

(12) United States Patent
Yamazaki

(10) Patent No.: US 7,819,782 B2
(45) Date of Patent: Oct. 26, 2010

(54) EXERCISE MACHINE

(75) Inventor: Iwao Yamazaki, Tokyo (JP)

(73) Assignee: Ya-Man Ltd., Tokyo (JP)

( * ) Notice: Subject to any disclaimer, the term of this patent is extended or adjusted under 35 U.S.C. 154(b) by 288 days.

(21) Appl. No.: 11/812,009

(22) Filed: Jun. 14, 2007

(65) Prior Publication Data

US 2008/0261781 A1 Oct. 23, 2008

(30) Foreign Application Priority Data

Apr. 18, 2007 (JP) ..... P2007-109805

(51) Int. Cl.
*A63B 69/08* (2006.01)
*A63B 21/068* (2006.01)
*A63B 21/008* (2006.01)

(52) U.S. Cl. ..... 482/73; 482/95; 482/112

(58) Field of Classification Search ..... 482/51–53, 482/62, 72–73, 92–96, 111–113, 122–123, 482/125–126, 131, 133; 472/95; 601/23; *A63B 22/04, A63B 21/008, 21/068, 69/08*
See application file for complete search history.

(56) References Cited

U.S. PATENT DOCUMENTS

| | | | | |
|---|---|---|---|---|
| 4,830,362 | A | 5/1989 | Bull | |
| 5,183,449 | A * | 2/1993 | DeCloux | 482/53 |
| 5,527,250 | A * | 6/1996 | Chen | 482/96 |
| 6,113,522 | A * | 9/2000 | Fontenot et al. | 482/111 |
| 7,326,151 | B2 * | 2/2008 | Peterson et al. | 482/61 |
| 7,387,594 | B1 * | 6/2008 | White et al. | 482/52 |
| 7,393,308 | B1 * | 7/2008 | Huang | 482/51 |
| 7,422,548 | B1 * | 9/2008 | Teng | 482/51 |
| 2006/0217238 | A1 * | 9/2006 | Liao | 482/72 |
| 2006/0281610 | A1 * | 12/2006 | Perez, Jr. | 482/130 |

FOREIGN PATENT DOCUMENTS

| | | |
|---|---|---|
| CA | 1317328 | 5/1993 |
| CN | 1208357 A | 2/1999 |
| DE | 39 12 220 A1 | 11/1989 |
| EP | 0 878 216 A1 | 11/1998 |
| EP | 1 190 739 A2 | 3/2002 |
| FR | 2 630 018 | 10/1989 |
| GB | 2 217 216 A | 10/1989 |
| JP | 55-52773 | 4/1980 |
| JP | 2-11176 | 1/1990 |
| JP | 3-195541 | 8/1991 |
| JP | 8-164222 | 6/1996 |
| JP | 2000-116818 | 4/2000 |
| JP | 3127376 | 11/2000 |
| JP | 3137990 | 12/2000 |
| JP | 2001-276009 | 10/2001 |
| JP | 2002-95772 | 4/2002 |
| JP | 2002-102384 | 4/2002 |
| JP | 2003-190347 | 7/2003 |
| JP | 2006-238 | 1/2006 |
| WO | WO 97/25107 | 7/1997 |

* cited by examiner

*Primary Examiner*—Loan Thanh
*Assistant Examiner*—Oren Ginsberg
(74) *Attorney, Agent, or Firm*—Finnegan, Henderson, Farabow, Garrett & Dunner, L.L.P.

(57) ABSTRACT

An exercise machine includes a supporting stage; a saddle arranged relatively for said supporting stage; a pedaling stage with a pair of pedals arranged relatively for said supporting stage; and a handle arranged relatively for said supporting stage. The pedaling stage is configured such that the pair of pedals are connected with one another via a first air pump.

7 Claims, 5 Drawing Sheets

(a)

(b)

EXERCISE MACHINE

CROSS-REFERENCE TO RELATED APPLICATIONS

This application is based upon and claims the benefit of priority from the prior Japanese Patent Application No. 2007-109805, filed on Apr. 18, 2007; the entire contents of which are incorporated herein by reference.

BACKGROUND OF THE INVENTION

1. Field of the Invention

The present invention relates to an exercise machine which is utilized by a user for exercise, as occasion demand, by supplementary using a driving means such as at least one motor which is provided at the drive of the exercise machine.

2. Description of the Related Art

A conventional foot-pedaling type exercise machine is composed of a saddle which is fixed at an exercise main body which is configured such that a user can sit down thereon under the condition that the user can stretch out his legs and a pair of pedals can be provided at the position where the user's feet can reach the pedals when the user sits down on the saddle and to which a given load can be applied. The conventional foot-pedaling type exercise machine is operated by the user's pedaling of the pedals from side to side under the condition that the user's feet is put on the pedals. In this case, the leg's muscle of the user can be mainly trained (see, e.g., Patent document No. 1).

Then, a horse riding type exercise machine, which is configured such that the saddle of the machine can be pitched vertically and laterally by means of coil spring, is also known (see, e.g., Patent Document No. 2).

[Patent Document No. 1] JP-A 2000-116818 (KOKAI)

[Patent Document No. 2] JP-A 2003-190347 (KOKAI)

Generally, it is desired for the exercise machine to conduct every part exercise of the body which consumes a large quantity of energy and conduct partial muscle training for a part of the body such as shoulders, legs and arms which is hoped to be slimmed down by the user.

In addition, it is desired for the exercise machine to conduct stepping exercise while the user sits down on the saddle. Generally, although the stepping exercise is conducted under the condition that the user stands, the stepping exercise is not appropriate for elder people and younger people because the stepping exercise requires long and high load training for the user.

With the foot-pedaling type exercise machine, however, exercising a part of the body such as the shoulders or the legs can be mainly conducted by applying a load to the user's muscle. In this case, the user pedals his or her legs from side to side and the user's body is balanced against the unstable pitching of the saddle. The foot-pedaling type exercise machine is not appropriate for the muscle training of the arms of the user and the development of a sense of balance. In addition, since the foot-pedaling type exercise machine requires large kinetic momentum, the foot-pedaling type exercise machine is not appropriate for users with less physical strength such as older people.

SUMMARY

It is an object of the present disclosure, in view of the above-described problems, to provide an exercise machine which can train muscles of the body by directly training the corresponding part of the body and can exercise every part of the body.

In order to achieve the above object, an aspect of the present disclosure relates to an exercise machine (first exercise machine) that includes a supporting stage; a saddle arranged in a first predetermined position relative to the supporting stage; a pedaling stage with a pair of pedals arranged in a second predetermined position relatively for the supporting stage; and a handle arranged in a third predetermined position relative to the supporting stage. The pedaling stage is configured such that the pair of pedals are connected with one another via a first air pump.

Another aspect of the present disclosure relates to an exercise machine (second exercise machine) that comprises a supporting stage; a saddle arranged in a first predetermined position relative to the supporting stage; a pedaling stage with a pair of pedals arranged in a second predetermined position relative to the supporting stage; and a handle arranged in a third predetermined position relative to the supporting stage. The handle includes a first pipe member and a second pipe member which is rotatably attached to the first pipe member; and the forefront of the first pipe member is connected with the supporting stage via an air pump. The second pipe member includes a gripper which is made of divided forefronts of the second pipe member which are elongated upward from the supporting stage.

According to the first exercise machine, the pair of pedals provided at the pedaling stage are connected with one another via the air pump. Therefore, when the user works one pedal, the other pedal is pumped up, and when the user works the other pedal, the one pedal is pumped up. In this way, since the pedals are connected with the air pump, a given load is applied to the user through the pedaling. As a result, if the user pedals from side to side, pedaling training can be conducted inherently so that the lea muscles can be trained. In this case, since the upper body of the user is inherently twisted from side to side, various parts of the user's body, such as the abdomen or shoulder of the user, can be exercised.

According to the second exercise machine, the handle includes the first pipe member and the second pipe member which is movably attached to the first pipe member. The second pipe member is elongated upward so as to form the gripper composed of the forefront members of the second pipe member which are divided to extend in two directions. Therefore, if the user holds the gripper of the second pipe member and moves the second pipe member forward and backward, the user can exercise the upper body and a part of the body such as the abdomen or shoulders. In other words, the user can exercise various parts of the body by using the second exercise machine.

As described hereinafter, if the electric pump is provided, both of the pedals can be pumped up and down simultaneously in addition to pumped up and down alternately from side to side because the electric pump can control the pressure against the pipe members.

In this way, due to the electric pump, since the pedals can be pumped from side to side alternately or simultaneously, the exercising load can be set for the user depending on the age and sex of the user.

In this case, the inner muscle of the user, such as greater psoas muscle, can be trained, and older users may be able to perform light exercise. Also, the rehabilitation exercise can be performed by a user recovering from illness.

When exercising using pedaling, both the first exercise machine and the second exercise machine are configured such that the position of the knee of the user is shifted above the position of the hip. In other words, both the first exercise machine and the second exercise machine are designed so that the thigh of the user contact the breast or the abdomen of the user. Namely, suppose that the position of the thigh of the user is set to zero degrees when the user stands, both the first exercise machine and the second exercise machine are designed so that the position of the thigh of the user can be varied up to 180 degrees from zero.

According to the first exercise machine and the second exercise machine, therefore, the inner muscle group located around the lower abdominal region such as the greater psoas muscle and the ligament group such as upper spinous ligament or interspinous ligament band can be exercised.

According to an embodiment, the forefront of the first pipe member is joined with the supporting stage via the second air pump so that a given load is applied to the arms and the shoulders of the user using the forward and backward movement of the handle. Therefore, the user can train the arms and the shoulders.

According to the first exercise machine and the second exercise machine, particularly, the user can conduct the intended exercise under the condition of backward tilting, and the user can train the biceps brachii and the muscle around the neck. Therefore, the user can slim down the double chin and the loosening upper arms.

According to an embodiment, the sides of the second pipe member of the handle are rotatably attached to the supporting stage so that the rotation of the second pipe member relative to the supporting stage can be in cooperation with the rotation of the second pipe member relative to the first pipe member. In this case, the user can operate the exercise machine so that there is cooperation between the rotation of the first pipe member and the second pipe member originating from the forward and backward movement of the second pipe member relative to the fixing portion in the supporting stage and the press of the second pump by the first pipe member associated with the rotation. As a result, the structure of the second exercise machine can be simplified so as to exhibit the inherent function/effect.

The sides of the second pipe member of the handle may be attached to the supporting stage so that the second pipe member can be moved forward and backward, that is, slid along the supporting stage. In this case, the forward and backward movement of the second pipe member relative to the supporting stage can cooperate with the rotation of the second pipe member relative to the first pipe member. In this case, the user can operate the exercise machine so that there is cooperation between the forward and backward movement of the second pipe member, that is, the rotation of the first pipe member and the second pipe member originating from the sliding of the second pipe member, and the press of the second pump by the first pipe member associated with the rotation. As a result, the structure of the second exercise machine can be simplified so as to exhibit the inherent function/effect.

In the first exercise machine, it is not always required that the handle is movable. For example, the handle may be fixed at the supporting stage. In the latter case, the user grasps the handle so that the user can pedal and exercise the abdomen or the shoulders safely. The handle may be a supplemental handle, which is different from the handle in the second exercise machine.

The first exercise machine and the second exercise machine may be used independently, but may be combined. For example, when the user conducts the pedaling exercise at the forward position of the handle, the user can train the muscle of the back and another muscle of the back selectively. When the user conducts the pedaling exercise at the backward position of the handle, the user can train the abdominal muscle and another muscle of the abdomen selectively.

In both of the first exercise machine and the second exercise machine, the saddle may be connected with the supporting stage via the elastic flexible member. In this case, since the saddle is pitched by the pedaling of the pedals and the forward-backward movement of the handle by the user, a complicated movement can be formed and applied to a part of the body of the user from the shoulders to the legs of the user. Therefore, the user can train the muscles from the shoulder to the legs simultaneously and also maintain a sense of balance.

A driving device to pitch the saddle via the elastic flexible member may be provided. In this case, the pitch of the saddle can be controlled freely so that a corresponding complicated pitch can be realized in addition to the pitch originated from the pedaling of the pedals and the movement of the handle by the user. Thus, the user can train with a better sense of balance.

As described above, the exercise machine can train muscles of the body by directly training the corresponding part of the body and can exercise every part of the body.

DETAILED DESCRIPTION OF THE INVENTION

Hereinafter, the present invention will be described in detail with reference to the drawings.

Figure 1:
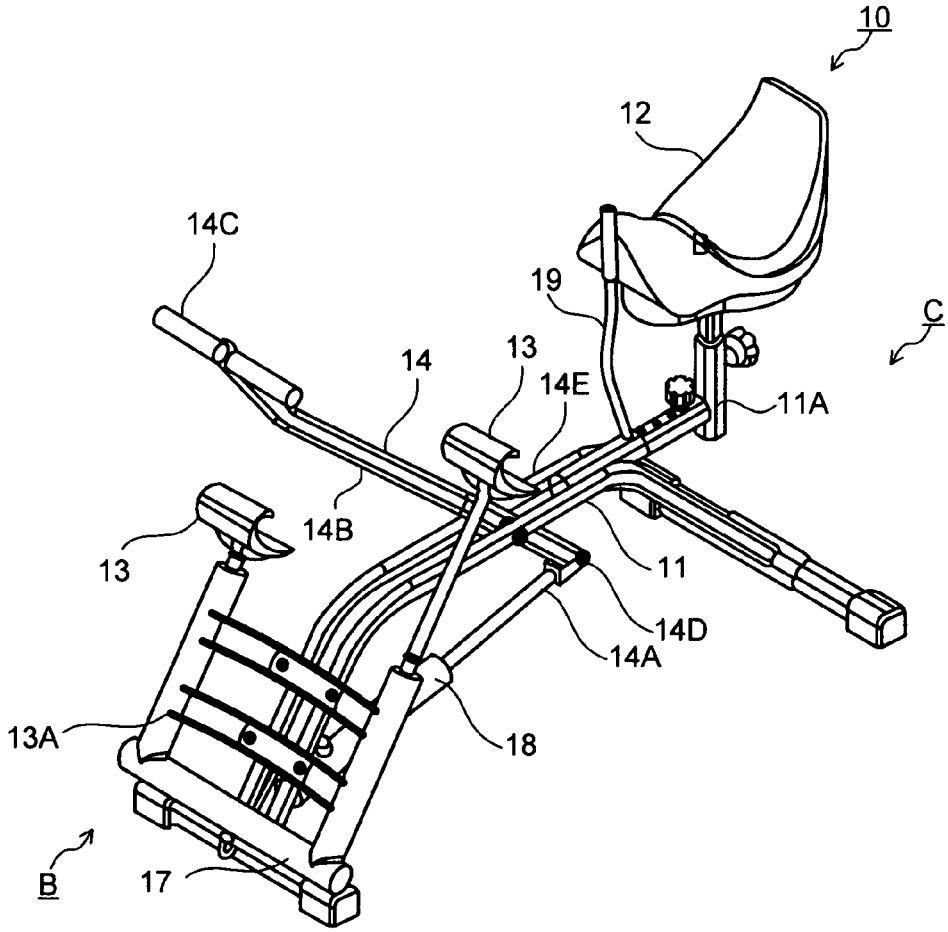
FIG. 1 is a perspective view illustrating an exercise machine according to the present invention.
Figure 2:
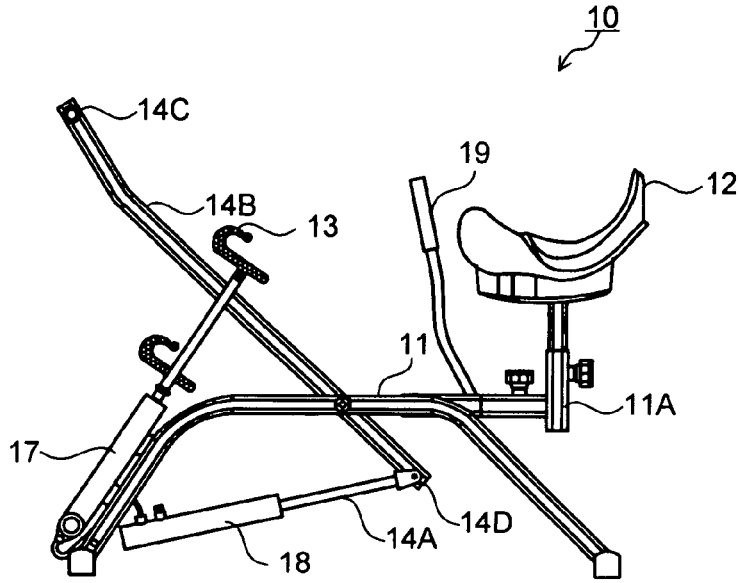
FIG. 2 is a side view of the exercise machine in FIG. 1, as viewed from the side designated by the arrow "A".
Figure 3:
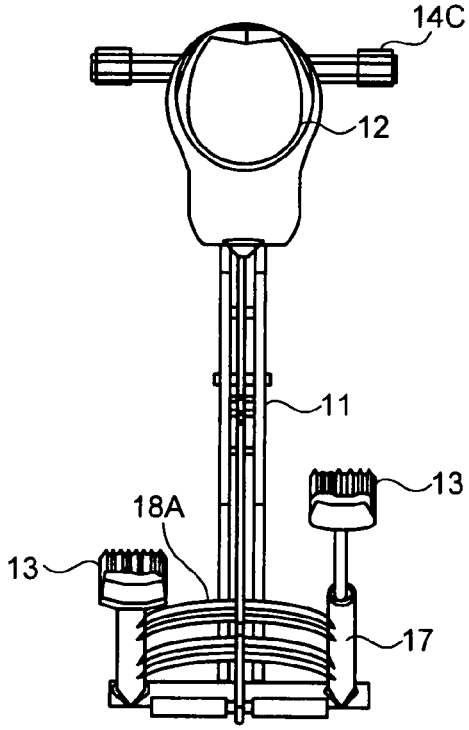
FIG. 3 is an elevational view of the exercise machine in FIG. 1, as viewed from the side-designated by the arrow "B".
Figure 4:
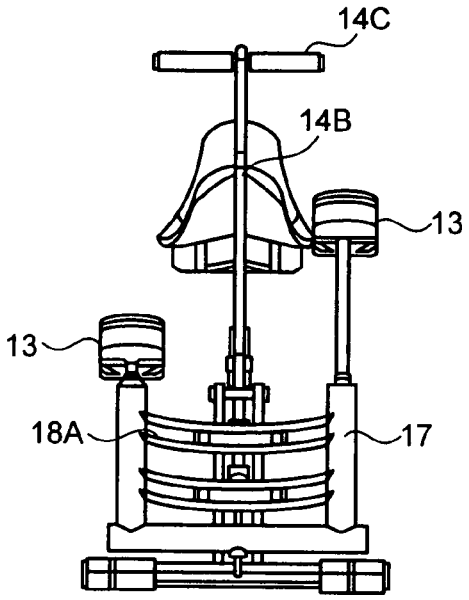
FIG. 4 is a backside view of the exercise machine in FIG. 1, as viewed from the side designated by the arrow "C".

FIGS. 1 to 4 relates to an exercise machine according to the present invention. FIG. 1 is a perspective view illustrating an exercise machine according to the present invention. FIG. 2 is a side view of the exercise machine in FIG. 1, as viewed from the side designated by the arrow "A". FIG. 3 is an elevational view of the exercise machine in FIG. 1, as viewed from the side designated by the arrow "B". FIG. 4 is a backside view of the exercise machine in FIG. 1, as viewed from the side designated by the arrow "C".

As illustrated in FIGS. 1 to 4, the exercise machine 10 in this embodiment includes a supporting stage 11, a saddle 12 and a pair of pedals 13. The supporting stage 11 is made of a pair of pipes of which the center regions are flat, of which the front ends are curved downward and of which the rear ends are curved downward so as to support the exercise machine 10 entirely. The saddle 12 is attached to a supplemental member 11A which is provided so as to be elongated backward from the supporting stage 11, curved and elongated upward at the rear end of the supporting stage 11. The pair of pedals 13 are provided at the front side of the supporting stage 11. Then, a U-shaped first air pump 17 is provided at the front side of the supporting stage 11 via an attachment 18A. The forefronts of the pedals 13 are inserted into the first air pump 17 and attached to the supporting stage 11 via the air pump 17.

The exercise machine 10 includes a handle 14 which contains a first pipe member 14A and a second pipe member 14B. A gripper 14C is provided at the forefront of the second pipe member 14B so as to be orthogonal to the second pipe member 14B. The gripper 14C is made of a pipe member so as to satisfy the above-mentioned description relating to the gripper 14C. Then, a second air pump 18 is provided at the front side of the supporting stage 11 so as to be elongated backward, and the forefront of the first pipe member 14A is inserted into the second air pump 18. The first pipe member 14A and the second pipe member 14B are rotatably attached to a joint 14D. The second pipe member 14*b* is rotatably attached to the supporting stage 11 via a joint 14E. As a result, the handle 14 is attached to the supporting stage 11 via the second air pump 18 and the joint 14E.

Then, a supplemental handle 19 is provided between the saddle 12 and the handle 14 so as to be attached to the supporting stage 11 and elongated upward. The supplemental handle 19 is provided so as not to contact with the saddle 12 and the handle 14.

To use the exercise machine shown in FIGS. 1 to 4, a user sits down on the saddle 12 and puts his feet on the pedals 13. As shown in FIGS. 1 and 2, since the forefronts of the pedals 13 are cylindrical, the user can insert his toes into the cylindrical spaces of the pedals 13 so as to fix his toes in the pedals 13. On the other hand, the user can grasp the gripper 14C with both hands so that the user can be fixed at the exercise machine 10.

The pedals 13 are connected with one another via the air pump 17. Since the first air pump 17 includes no valve therein, the other pedal is pumped up when the user works one pedal and the one pedal is pumped up when the user works the other pedal, since the interior pressure of the first air pump is maintained constantly. In this case, since the pedals 13 are connected with the first air pump 17, a given load is applied to the user through the pedaling. As a result, if the user pedals from side to side, the pedaling can be conducted inherently so that the muscles of the legs can be exercised. In this case, since the upper body of the user is inherently twisted from side to side, the user can exercise every part of the body, such as the abdomen or shoulders.

The first air pump 17 is pressurized when the user works the pedals 13 simultaneously, but depressurized to the inherent pressure thereof when the user stops to work the pedals 13.

Only the pedaling exercise can be conducted safely if the user grasps the supplemental handle 19 fixed at the supporting stage 11.

If the user grasps the gripper 14C and moves the handle 14 forward and backward, the exercise of the upper body and the exercise of a part of the body such as the abdomen or the shoulders, that is, the exercise of every part body can be realized because a given load is applied to the corresponding part(s) of the user from the second air pump 18. Herein, since the second air pump 18 includes a check valve, the interior pressure can not be increased to the inherent pressure when the user draws the second air pump 18. Therefore, the second air pump 18 may be utilized for the control of the interior pressure.

The pedaling exercise may be combined with the handle moving exercise. For example, when the user conducts the pedaling exercise at the forward position of the handle 14, the user can train the muscle of the back and another muscle of the back selectively. When the user conducts the pedaling exercise at the backward position of the handle 14, the user can train the abdominal muscle and another muscle of the abdomen selectively.

Then, the sides of the second pipe member 14B of the handle 14 can be rotatably attached to the supporting stage 11 so that the rotation of the second pipe member 14B relative to the supporting stage 11 can be in cooperation with the rotation of the second pipe member relative to the first pipe member 14A. In this case, the user can operate the exercise machine 10 so that there is cooperation between the rotation of the first pipe member 14A and the second pipe member 14B originating from the forward and backward movement of the second pipe member 14B relative to the fixing portion in the supporting stage 11 and the press of the second air pump 18 by the first pipe member 14A associated with the rotation. As a result, the structure of the exercise machine 10 using the handle 14 and the pedals 13 can be simplified.

The sides of the second pipe member 14B of the handle 14 may be attached to the supporting stage 11 so that the second pipe member 14B can be moved forward and backward, that is, slid along the supporting stage 11. In this case, the forward and backward movement of the second pipe member 14B relative for the supporting stage 11 can cooperate with the rotation of the second pipe member 14B relative for the first pipe member 14A. In this case, the user can operate the exercise machine 10 so that there is cooperation between the forward and backward movement of the second pipe member 14B, that is, the rotation of the first pipe member 14A and the second pipe member 14B originating from the sliding of the second pipe member 14B, and the press of the second air pump 18 by the first pipe member 14A associated with the rotation. As a result, the structure of the exercise machine 10 can be simplified so as to exhibit the inherent function/effect.

According to the exercise machine in this embodiment, a given load can be applied directly to a part of the body which is hoped to be slimmed down by the user so that the corresponding muscle of the part of the body can be trained, and the exercise of every part of the body can be realized.

Figure 5:
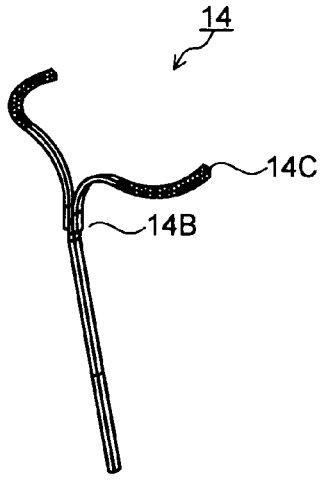
FIG. 5 is a view illustrating a modified embodiment of the handle of the exercise machine in FIGS. 1 to 4.

FIG. 5 is a view illustrating a modified embodiment of the handle 14 of the exercise machine 10 in FIGS. 1 to 4. As is apparent from FIG. 5, the handle 14 is made of a pair of pipes of which the gripper 14C is continued from the second pipe member 14B, divided upward and curved for the front side (the rear side of the exercise machine). In this case, the user can conduct the pedaling exercise and/or the handle-moving exercise by grasping the gripper 14C of the handle 14.

Figure 6:
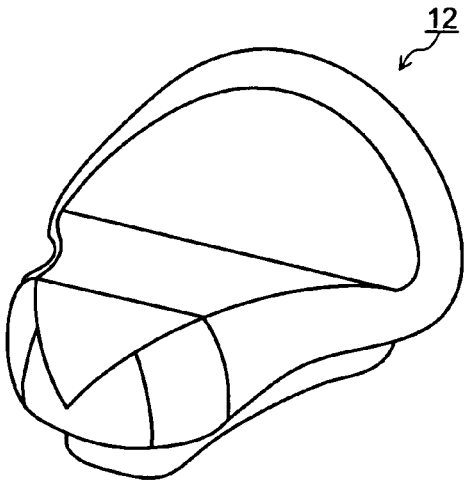
FIG. 6 is a view illustrating a modified embodiment of the saddle of the exercise machine in FIGS. 1 to 4.
Figure 6:
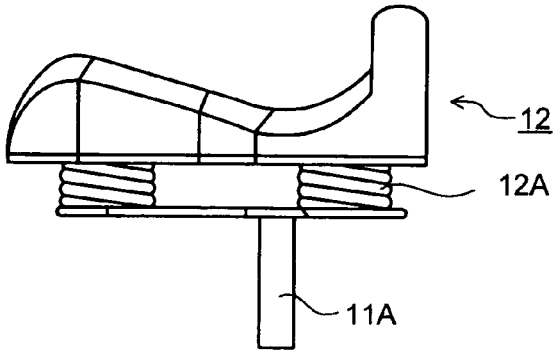

FIG. 6 is a view illustrating a modified embodiment of the saddle 12 of the exercise machine 10 in FIGS. 1 to 4. As is apparent from FIG. 6, in this embodiment, the saddle 12 is attached to the supplemental member 11A elongated from the supporting stage 11 via a coil spring 12A. In this case, since the saddle 12 is pitched by the pedaling of the pedals 13 and the forward-backward movement of the handle 14 by the user, a complicated movement can be formed and applied to a part of the body of the user from the shoulders to the legs while the user maintains the balance on the saddle 12. Therefore, the user can train the muscles of the arms and the legs simultaneously and also, the sense of balance.

Figure 7:
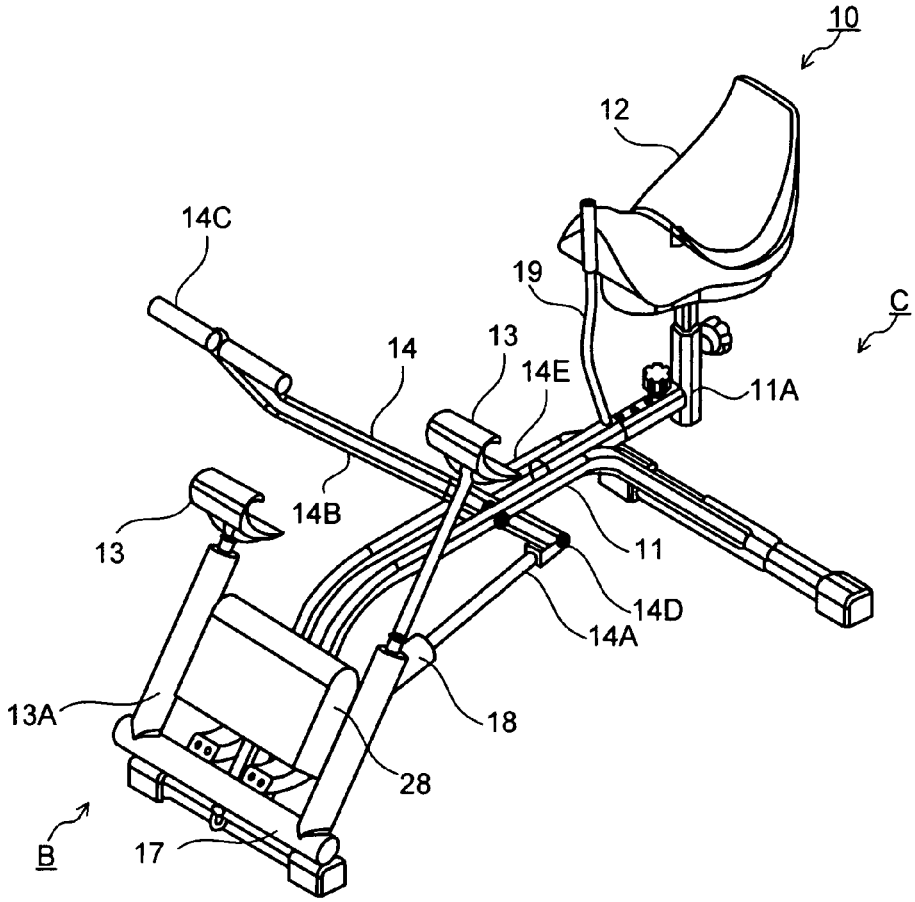
FIG. 7 is a perspective view illustrating another exercise machine according to the present invention.
Figure 8:
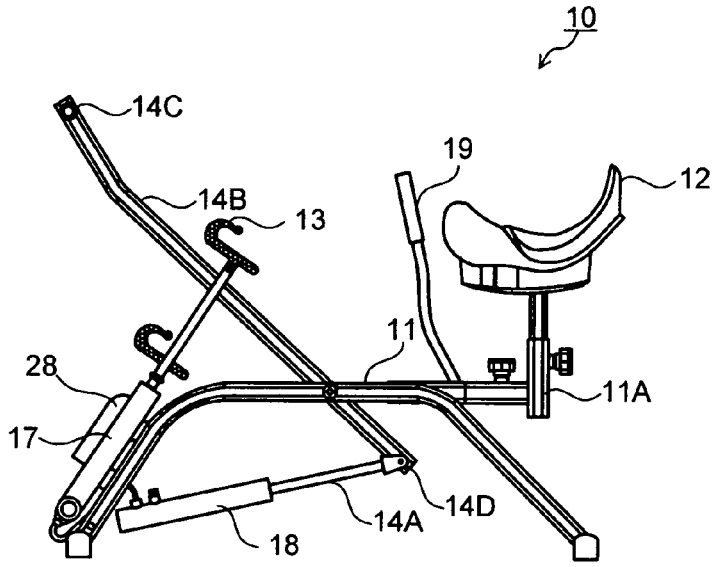
FIG. 8 is a side view of the exercise machine in FIG. 7, as viewed from the side designated by the arrow "A".
Figure 9:
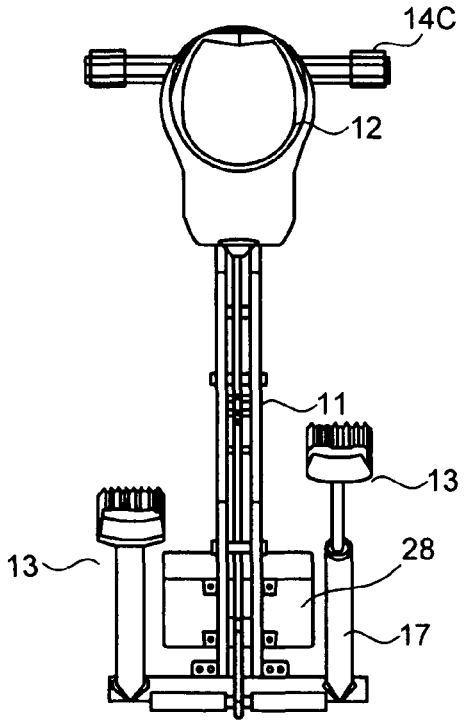
FIG. 9 is an elevational view of the exercise machine in FIG. 7, as viewed from the side designated by the arrow "B".
Figure 10:
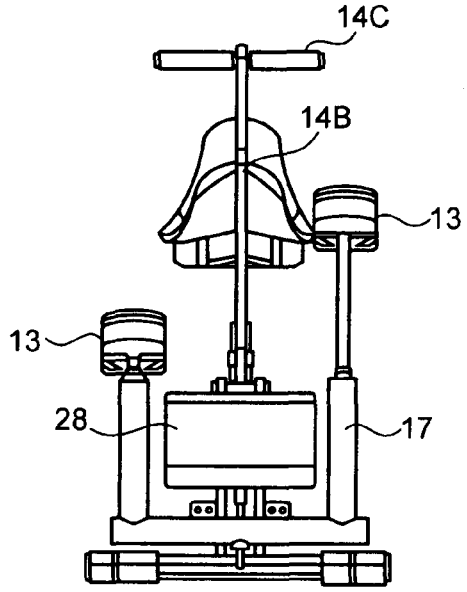
FIG. 10 is a backside view of the exercise machine in FIG. 7, as viewed from the side designated by the arrow "C".

Particularly not shown, a driving device to pitch the saddle 12 three-dimensionally via the coil spring 12A may be provided. In this case, the pitch of the saddle 12 can be controlled freely so that the corresponding complicated pitch can be realized in addition to the pitch originated from the pedaling of the pedals 13 and the movement of the handle 14 by the user and thus, the user can train the sophisticated sense of balance. FIGS. 7 to 10 relates to another exercise machine according to the present invention, which is modified from the one in FIGS. 1 to 4. FIG. 7 is a perspective view illustrating another exercise machine according to the present invention. FIG. 8 is a side view of the exercise machine in FIG. 7, as viewed from the side designated by the arrow "A". FIG. 9 is an elevational view of the exercise machine in FIG. 7, as viewed from the side designated by the arrow "B". FIG. 10 is a backside view of the exercise machine in FIG. 7, as viewed from the side designated by the arrow "C".

The exercise machine in this embodiment is different from the one in the embodiment relating to FIGS. 1 to 4 because the exercise machine uses an electric pump instead of the air pump. Concretely, a control box 28 is disposed in the inner space of the U-shaped first air pump 17 which is provided at the front side of the supporting stage 11 so that the interior pressure of the first air pump 17 is increased by supplying air into the first air pump 17 and decreased by exhausting the air from the first air pump 17 through the operation of the absorbing-exhausting pump of the control box 20. The supplying and exhausting operation of air by the control box 28 can shift the pedals 13 vertically. In this point of view, the control box 20 containing the absorbing-exhausting pump therein can function as the electric pump.

The absorbing-exhausting pump may be composed of two pumps for absorbing and exhausting, but may be composed of one pump only if the pump contained in the control box 27 can realize the absorbing and exhausting by itself. The electric pump may be connected to the first air pump 17 via a connecting tube (not shown). In this case, the interior pressure of the first air pump 17 can be increased and decreased through the operation of the control box 28 (electric pump contained therein) with the hand switch. Therefore, the interior pressure of the first air pump 17 can be controlled by the combination of the manual operation as described in the above embodiment and the switching operation by the hand switch.

Although the present invention was described in detail with reference to the above examples, this invention is not limited to the above disclosure and every kind of variation and modification may be made without departing from the scope of the present invention.

What is claimed is:

1. An exercise machine, comprising:

a supporting stage;

a saddle arranged in a first predetermined position relative to said supporting stage;

a pedaling stage with a pair of pedals arranged in a second predetermined position relative to said supporting stage; and a handle arranged in a third predetermined position relative to said supporting stage, wherein said pedaling stage is configured such that said pair of pedals are inserted directly into a first air pump and connected with one another via the first air pump;

wherein the handle includes a first pipe member and a second pipe member that is rotatable attached to the first pipe member; and wherein the forefront of the first pipe member is connected to the supporting stage via a second air pump, the second pipe member includes a gripper that is made of divided forefronts of the second pipe member, and the divided forefronts of the second pipe member are elongated upward from the supporting stage; wherein the exercise machine is engageable in an exercising motion by pulling the handle toward the saddle, causing the saddle to pivot with respect to the supporting stage and toward the handle.

2. The exercise machine as set forth in claim 1, wherein the sides of said second pipe member of said handle are rotatably attached to said supporting stage so that the rotation of said second pipe member relative to said supporting stage can be in cooperation with the rotation of said second pipe member relative to said first pipe member.

3. The exercise machine as set forth in claim 1, wherein the sides of said second pipe member of said handle are attached to said supporting stage movably forward and backward so that the forward and backward movement of said second pipe member relative to said supporting stage can be in cooperation with the rotation of said second pipe member relative to said first pipe member.

4. The exercise machine as set forth in claim 1, further comprising a supplemental handle fixed at said supporting stage.

5. The exercise machine as set forth in claim 1, wherein said second air pump is operated by means of electric motive force or another motive force except manual motive force.

6. The exercise machine as set forth in claim 1, wherein said saddle is connected with said supporting stage via an elastic flexible member.

7. The exercise machine as set forth in claim 1, wherein at least one of said first air pump and said second air pump is configured such that an exercise load can be controlled by increasing and decreasing the interior pressure thereof.

* * * * *

UNITED STATES PATENT AND TRADEMARK OFFICE

CERTIFICATE OF CORRECTION

PATENT NO. : 7,819,782 B2
APPLICATION NO. : 11/812009
DATED : October 26, 2010
INVENTOR(S) : Yamazaki It is certified that error appears in the above-identified patent and that said Letters Patent is hereby corrected as shown below:

Claim 1, column 8, line 10, change “rotatable attached” to --rotatably attached--.

Signed and Sealed this
Eleventh Day of January, 2011

David J. Kappos

David J. Kappos
*Director of the United States Patent and Trademark Office*